US005911657A

United States Patent [19]

Meiners

[11] Patent Number: 5,911,657

[45] Date of Patent: Jun. 15, 1999

[54] CUSHION WITH INFLATION MEANS DEFINED BY INTERLOCKING RIBS

[76] Inventor: Devoine Meiners, 239 S. Main, Wykoff, Minn. 55990

[21] Appl. No.: 08/955,595

[22] Filed: Oct. 22, 1997

[51] Int. Cl.[6] ..... A47C 27/10

[52] U.S. Cl. ..... 5/710; 5/655.3

[58] Field of Search ..... 5/710, 706, 655.3, 5/654, 420, 644; 383/3, 63; 206/522

[56] References Cited

U.S. PATENT DOCUMENTS

| | | | |
|---|---|---|---|
| 3,428,974 | 2/1969 | Stuart | 5/710 |
| 3,818,962 | 6/1974 | Muller-Scherak | 5/710 |
| 4,962,553 | 10/1990 | Marquis | 5/710 |
| 5,664,296 | 9/1997 | May | 383/63 |
| 5,711,609 | 1/1998 | Simonsen | 383/63 |

*Primary Examiner*—Alex Grosz

[57] ABSTRACT

A new inflatable cushion for providing padding that is quick and easy to inflate and deflate. The inventive device includes a series of connected mattress sections with each the mattress section including an inflatable first cell member coupled to an inflatable second cell member such that second cell member may be folded over the first cell member so that the side of the series may be used as a cover for the other side of the series. Each cell member includes an opening into their respective hollow interiors for permitting inflation and deflation of the cell member. Each cell member also includes interlocking ribs on the perimeter of the opening into the cell member hollow interior to provide a sealing means for permitting the formation of a substantially air tight closure each opening.

14 Claims, 3 Drawing Sheets

10
12
13
20
22
24
25
26
30
32
34
35
40
44
45
50
60
2
4

30
32
34
50
3

CUSHION WITH INFLATION MEANS DEFINED BY INTERLOCKING RIBS

BACKGROUND OF THE INVENTION

1. Field of the Invention

The present invention relates to inflatable cushions and more particularly pertains to a new inflatable cushion for providing padding that is quick and easy to inflate and deflate.

2. Description of the Prior Art

The use of inflatable cushions is known in the prior art. More specifically, inflatable cushions heretofore devised and utilized are known to consist basically of familiar, expected and obvious structural configurations, notwithstanding the myriad of designs encompassed by the crowded prior art which have been developed for the fulfillment of countless objectives and requirements.

Known prior art inflatable cushions include U.S. Pat. No. 4,708,393; U.S. Pat. No. 4,592,589; U.S. Pat. No. Des. 253,983; U.S. Pat. No. 4,277,859; U.S. Pat. No. 5,191,665; and U.S. Pat. No. 5,013,272.

While these devices fulfill their respective, particular objectives and requirements, the aforementioned patents do not disclose a new inflatable cushion. The inventive device includes a series of connected mattress sections with each the mattress section including an inflatable first cell member coupled to an inflatable second cell member such that second cell member may be folded over the first cell member so that the side of the series may be used as a cover for the other side of the series. Each cell member includes an opening into their respective hollow interiors for permitting inflation and deflation of the cell member. Each cell member also includes a sealing means for permitting the formation of a substantially air tight closure each opening.

In these respects, the inflatable cushion according to the present invention substantially departs from the conventional concepts and designs of the prior art, and in so doing provides an apparatus primarily developed for the purpose of providing padding that is quick and easy to inflate and deflate.

SUMMARY OF THE INVENTION

In view of the foregoing disadvantages inherent in the known types of inflatable cushions now present in the prior art, the present invention provides a new inflatable cushion construction wherein the same can be utilized for providing padding that is quick and easy to inflate and deflate.

The general purpose of the present invention, which will be described subsequently in greater detail, is to provide a new inflatable cushion apparatus and method which has many of the advantages of the inflatable cushions mentioned heretofore and any novel features that result in a new inflatable cushion which is not anticipated, rendered obvious, suggested, or even implied by any of the prior art inflatable cushions, either alone or in any combination thereof.

To attain this, the present invention generally comprises a series of connected mattress sections with each the mattress section including an inflatable first cell member coupled to an inflatable second cell member such that second cell member may be folded over the first cell member so that the side of the series may be used as a cover for the other side of the series. Each cell member includes an opening into their respective hollow interiors for permitting inflation and deflation of the cell member. Each cell member also includes a sealing means for permitting the formation of a substantially air tight closure each opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable cushion apparatus and method which has many of the advantages of the inflatable cushions mentioned heretofore and many novel features that result in a new inflatable cushion which is not anticipated, rendered obvious, suggested, or even implied by any of the prior art inflatable cushions, either alone or in any combination thereof.

It is another object of the present invention to provide a new inflatable cushion which may be easily and efficiently manufactured and marketed.

It is a further object of the present invention to provide a new inflatable cushion which is of a durable and reliable construction.

An even further object of the present invention is to provide a new inflatable cushion which is susceptible of a low cost of manufacture with regard to both materials and labor, and which accordingly is then susceptible of low prices of sale to the consuming public, thereby making such inflatable cushion economically available to the buying public.

Still yet another object of the present invention is to provide a new inflatable cushion which provides in the apparatuses and methods of the prior art some of the advantages thereof, while simultaneously overcoming some of the disadvantages normally associated therewith.

Still another object of the present invention is to provide a new inflatable cushion for providing padding that is quick and easy to inflate and deflate.

Yet another object of the present invention is to provide a new inflatable cushion which includes a series of connected mattress sections with each the mattress section including an inflatable first cell member coupled to an inflatable second cell member such that second cell member may be folded over the first cell member so that the side of the series may be used as a cover for the other side of the series. Each cell member includes an opening into their respective hollow interiors for permitting inflation and deflation of the cell member. Each cell member also includes a sealing means for permitting the formation of a substantially air tight closure each opening.

Still yet another object of the present invention is to provide a new inflatable cushion that can be inflated very quickly to provide a soft cushion.

Even still another object of the present invention is to provide a new inflatable cushion that deflated very quickly and easily foldable so that it can be quickly and conveniently stored.

Even yet still another object of the present invention is to provide a new inflatable cushion that can be inflated and used as an emergency floatation device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
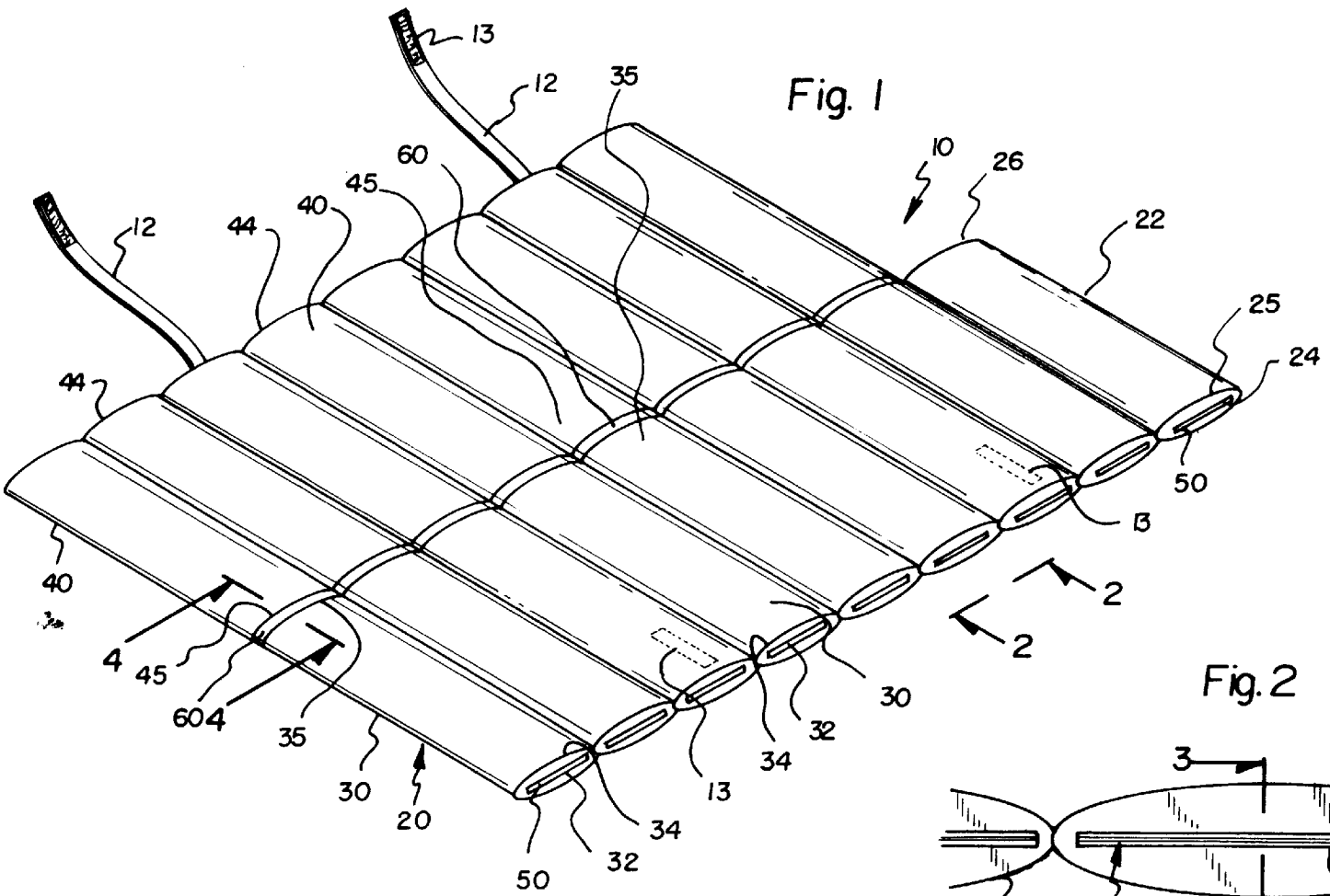
FIG. 1 is a schematic perspective view of a new inflatable cushion according to the present invention.
Figure 2:
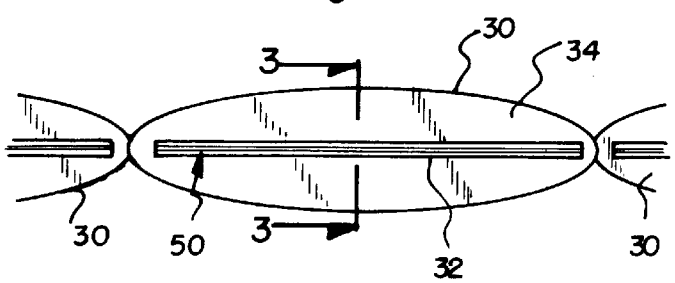
FIG. 2 is a schematic side view of the present invention taken from the vantage point of line 2—2 on FIG. 1.

With reference now to the drawings, and in particular to FIGS. 1 through 6 thereof, a new inflatable cushion embodying the principles and concepts of the present invention and generally designated by the reference numeral 10 will be described.

As best illustrated in FIGS. 1 through 6, the inflatable cushion 10 generally comprises a series of connected mattress sections 20 with each the mattress section including an inflatable first cell member 30 coupled to an inflatable second cell member 40 such that second cell member 40 may be folded over the first cell member 30 so that the side of the series may be used as a cover for the other side of the series. Each cell member 30,40 includes an opening 32 into their respective hollow interiors 31,41 for permitting inflation and deflation of the cell member. Each cell member also includes a sealing means 50 for permitting the formation of a substantially air tight closure for each opening 32.

Preferably, the first and second cell members 30,40 are aligned so that the second end 35,45 of each of the cell members are coupled together. Even more preferably, each mattress section includes a hinge member 60 to couples the first cell member second end 35 to the second cell member second end 45 such that the second cell member 40 may be folded over the first cell member 30. Ideally, the hinge-member 60 is a living hinge formed between the second ends 35,45 of the cell members.

In such an embodiment of the invention, it is preferred that the opening 32 of each cell member 34,40 is located at the first end 34,44 of their respective cell member. This location of the openings 32 helps provide easy access to the openings when inflating or deflating each cell member 30,40.

Optionally, this embodiment of the inflatable cushion 10 may also include an inflatable head rest cell member 22 coupled to a mattress section 20. As shown in FIG. 1, it is preferred that the head rest cell member 22 is positioned at an end of the series of mattress sections 20. Ideally, the head rest cell member 22 is coupled to a the first cell member 30 at the end of the series. The head rest member 22 is preferably similar in shape and construction as the other cell members 30,40 and includes an opening 24 into its hollow interior with its own sealing means 50 for closing the head rest cell member opening 24. As with the other cell members, it is also preferable that the opening 24 is located at either the first end or the second end 26 of the head rest cell member 22.

Also optionally, the inflatable cushion 10 includes a flexible strap 12 extending from a second cell member 40. When the second cell member 40 is folded over the first cell member 30, the strap 12 is attachable to a first cell member 30 to help hold the second cell member 40 in a folded position over the first cell member 30. Ideally, the strap 12 is attachable to the first cell member 30 by some sort of detachable fastener such as a hook and loop fastener 13. As shown in FIG. 1, the invention may be provided with a pair of straps 12 or any number of straps to help hold the second cell members 40 over the first cell members 30 when in the folded position.

Figure 3:
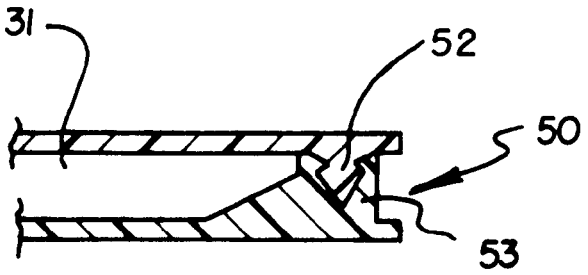
FIG. 3 is a schematic cross-sectional view taken from line 3—3 on FIG. 2 of the interlocking ribs of a cell member.
Figure 4:
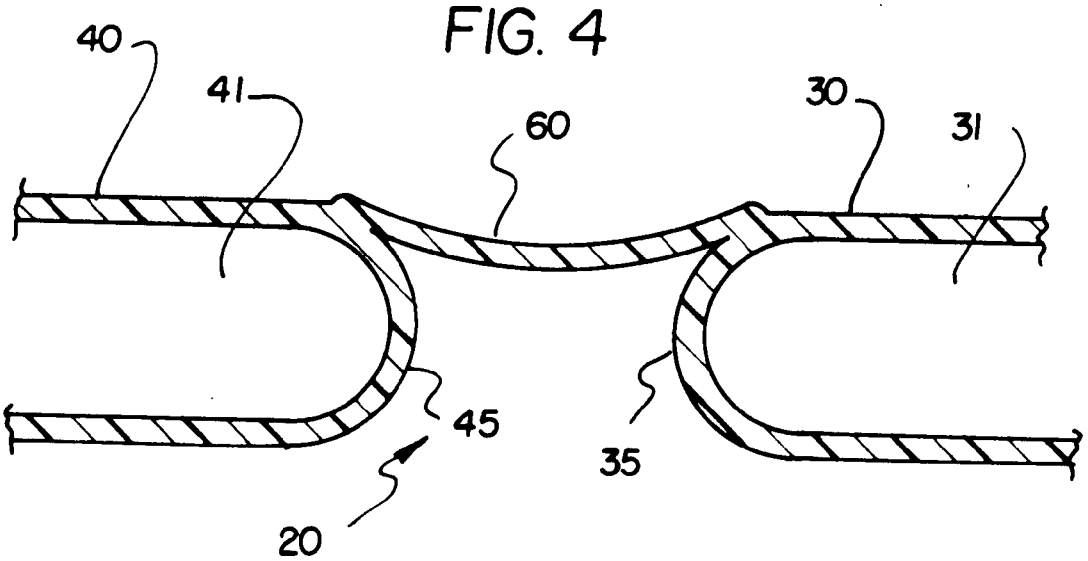
FIG. 4 is a schematic cross-section view of the hinge member coupling a first cell member to a second cell member taken from line 4—4 on FIG. 1.

Preferably, as shown in FIG. 3, the sealing means 50 for each of the openings of the first, second and head rest cell members 30,40,22 is comprised of a plurality of interlocking sealing ribs 52,53 provided on the perimeter of each cell member openings. The interlocking sealing ribs 52,53 permit the formation of a substantially air tight closure of each cell member's opening when the ribs are interlock so that air within the hollow interior of the cell member is trapped with the hollow interior when the ribs 52,53 are interlocked.

In use, each cell member of the invention 10 may be inflated by opening the opening of the cell member and either shaking the cell member or inserting a hand into the hollow interior of the cell member so that the hollow interior of the cell member is filled with air. The interlocking ribs around the opening are then interlocked to form a substantially air tight seal of the opening. The amount of air trapped within the hollow interior may be adjusted to provide any degree of firmness by slightly opening the opening to release excess air from the hollow interior and then resealing the opening.

Figure 5:
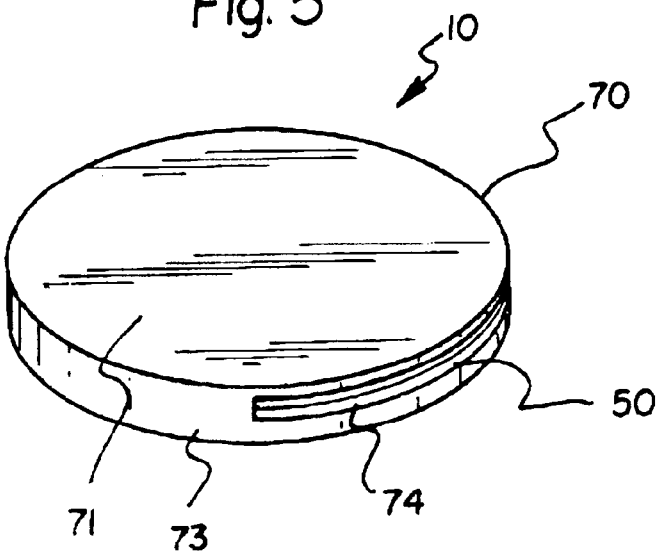
FIG. 5 is a schematic perspective view of a circular embodiment of the present invention
Figure 6:
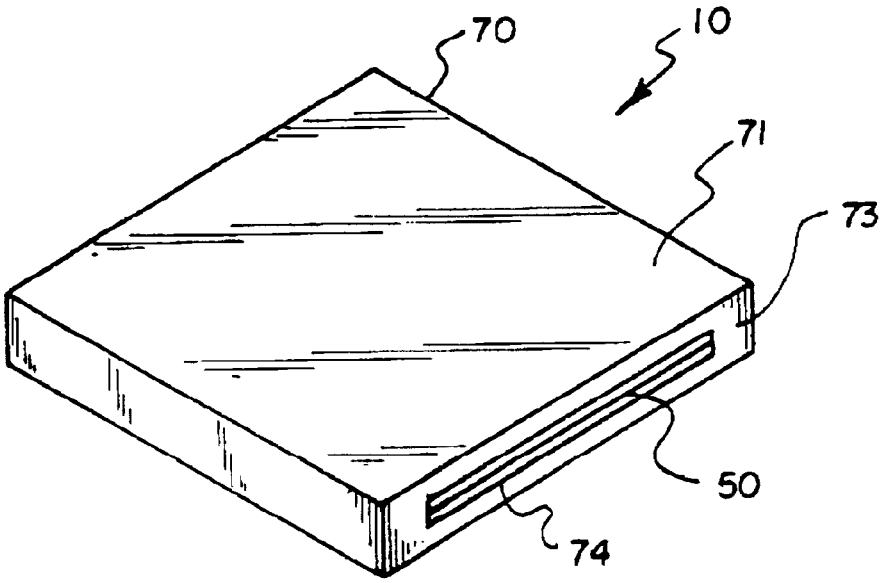
FIG. 6 is a schematic perspective view of a rectangular embodiment of the present invention

With reference to FIGS. 5 and 6, the inflatable cushion may be designed from a single cell member 70 with upper surface 71 and lower surfaces (not shown), and a side wall 73. Preferably the opening 74 into the hollow interior of the cell member 70 is located on the side wall 74 and includes a sealing means 50 such as interlocking ribs. Preferably, as shown in FIG. 5, the cell member 70 may be circular in shape or rectangular in shape as shown in FIG. 6. This embodiment may be constructed in any size so that it may be used as a seat cushion, a mattress, or an emergency floatation device. the perimeter of the cell member opening having a plurality of interlocking sealing ribs for closing the cell member opening, wherein the interlocking sealing ribs of the cell member opening perimeter permit the forming of a substantially air tight closure of the first cell member opening.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable cushion, comprising:

a series of connected mattress sections, each said mattress section comprising:

an inflatable first cell member having a hollow interior, and an opening into said hollow interior of said first cell member;

first sealing means comprised of interlocking ribs, for closing said first cell member opening, said first sealing means permitting formation a substantially air tight closure of said first cell member opening;

an inflatable second cell member having a first end, a second end, a hollow interior, and an opening into said hollow interior of said second cell member, said second cell member opening having a perimeter, said second cell member opening being located at said second cell member first end;

second sealing means comprised of interlocking ribs, for closing said second cell member opening, said second sealing means permitting formation a substantially air tight closure of said second cell member opening; and said first cell member being coupled to said second cell member.

2. The inflatable cushion of claim 1, wherein said first cell member opening has a perimeter, wherein said second cell member opening has a perimeter, wherein said first sealing means comprises a plurality of interlocking sealing ribs provided on said perimeter of said first cell member opening, said interlocking ribs of said first sealing means being for closing said first cell member opening, wherein said interlocking sealing ribs of said first cell member opening perimeter permit the forming of a substantially air tight closure of said first cell member opening, and wherein said second sealing means comprises a plurality of interlocking sealing ribs provided on said perimeter of said second cell member opening, said interlocking ribs of said second sealing means being for closing said second cell member opening, wherein said interlocking sealing ribs of said second cell member opening perimeter permit the forming of a substantially air tight closure of said second cell member opening.

3. The inflatable cushion of claim 1, wherein said first cell member has a first end and a second end, wherein said second cell member has a first end and a second end, said first cell member second end being coupled to said second cell member second end such that said second cell member may be folded over said first cell member.

4. The inflatable cushion of claim 3, wherein a hinge member couples said first cell member second end to said second cell member second end such that said second cell member may be folded over said first cell member.

5. The inflatable cushion of claim 4, wherein said hinge member is a living hinge formed between said first cell member second end and said second cell member second end.

6. The inflatable cushion of claim 3, wherein said first cell member opening is located at said first cell member first end, and wherein said second cell member opening is located at said second cell member first end.

7. The inflatable cushion of claim 1, further comprising an inflatable head rest cell member, said head rest cell member having a hollow interior, and an opening into said hollow interior of said head rest cell member, and a third sealing means for closing said head rest cell member opening, said third sealing means permitting formation a substantially air tight closure of said head rest cell member opening, said head rest cell member being coupled to a said mattress section.

8. The inflatable cushion of claim 7, wherein said head rest cell member has a first end and a second end, said head rest cell member opening being located at said head rest cell member first end.

9. The inflatable cushion of claim 8, wherein said head rest cell member opening has a perimeter, wherein said third sealing means comprises a plurality of interlocking sealing ribs being provided on said perimeter of said head rest cell member, said interlocking ribs of said third sealing means being for closing said head rest cell member opening, wherein said interlocking sealing ribs of said head rest cell member opening perimeter permit the forming of a substantially air tight closure of said head rest cell member opening.

10. The inflatable cushion of claim 8, wherein said head rest cell member is coupled to a said first cell member of a said mattress section.

11. The inflatable cushion of claim 10, wherein said head rest cell member is positioned at an end of said series of mattress sections.

12. The inflatable cushion of claim 1, further comprising a flexible strap, said strap being extended from a said second cell member, said strap being couplable to a said first cell member to help hold said second cell member in a folded position over said first cell member.

13. The inflatable cushion of claim 12, further comprising a plurality of flexible straps.

14. An inflatable cushion, comprising:

a series of connected mattress sections, each said mattress section comprising:

an inflatable first cell member having a first end, a second end, a hollow interior, and an opening into said hollow interior of said first cell member, said first cell member opening having a perimeter, said first cell member opening being located at said first cell member first end;

said perimeter of said first cell member opening having a plurality of interlocking sealing ribs for closing said first cell member opening, wherein said interlocking sealing ribs of said first cell member opening perimeter permit the forming of a substantially air tight closure of said first cell member opening;

an inflatable second cell member having a first end, a second end, a hollow interior, and an opening into said hollow interior of said second cell member, said second cell member opening having a perimeter, said second cell member opening being located at said second cell member first end;

said perimeter of said second cell member opening having a plurality of interlocking sealing ribs for closing said second cell member opening, wherein said interlocking sealing ribs of said second cell member opening perimeter permit the forming of a substantially air tight closure of said second cell member opening;

a hinge member coupling said first cell member second end to said second cell member second end such that said second cell member may be folded over said first cell member;

an inflatable head rest cell member having a first end, a second end, a hollow interior, and an opening into said hollow interior of said head rest cell member, said head rest cell member opening having a perimeter, said head rest cell member opening being located at said head rest cell member first end;

said perimeter of said head rest cell member opening having a plurality of interlocking sealing ribs for closing said head rest cell member opening, wherein said interlocking sealing ribs of said head rest cell member opening perimeter permit the forming of a substantially air tight closure of said head rest cell member opening;

said head rest cell member being coupled to a said first cell member of a said mattress section, said head rest cell member being positioned at an end of said series of mattress sections; and a pair of flexible straps, each said strap being extended from a said second cell member, each said strap being couplable to a said first cell member to help hold said second cell member in a folded position over said first cell member.

* * * * *